United States Patent [19]

Montmarquet, Jr.

[11] 4,268,576

[45] May 19, 1981

[54] STENCIL SHEET WITH SOLVENTLESS COATING AND METHOD OF PREPARATION

[75] Inventor: Francis H. Montmarquet, Jr., Little Falls, N.J.

[73] Assignee: Repeat-O-Type Stencil Manufacturing Co., Inc., Wayne, N.J.

[21] Appl. No.: 113,311

[22] Filed: Jan. 18, 1980

[51] Int. Cl.[3] ..... B05D 3/06

[52] U.S. Cl. ..... 428/342; 101/128.21; 204/159.22; 260/31.8 R; 427/54.1; 428/511; 428/514; 430/281; 430/286; 430/308; 430/916

[58] Field of Search ..... 427/54.1, 44; 430/308, 430/281, 286, 288, 916; 101/128.21; 260/31.8 R; 204/159.22; 428/340, 341, 342, 500, 511, 514

[56] References Cited

U.S. PATENT DOCUMENTS

| | | | |
|---|---|---|---|
| 1,494,667 | 5/1924 | Coe | 430/308 |
| 2,969,731 | 1/1961 | Kendall | 430/308 |
| 2,969,732 | 1/1961 | Kendall | 430/308 |
| 4,012,559 | 3/1977 | Fujioka et al. | 260/31.8 R |

OTHER PUBLICATIONS

Cole, "IBM Tech. Disc. Bull.", vol. 20, No. 6, p. 2471, Nov. 1977.

*Primary Examiner*—John H. Newsome
*Attorney, Agent, or Firm*—Norman N. Popper; Daniel H. Bobis

[57] ABSTRACT

A stencil sheet is prepared with an ink-impervious coating of a film forming, solventless olefinic material. The coating includes a photopolymerization initiator, and may be applied to a tissue base in liquid form and thereafter cured by exposure to ultraviolet radiation. The present invention reduces the cost and pollution generation that conventionally attends the preparation of stencil sheets.

25 Claims, No Drawings

STENCIL SHEET WITH SOLVENTLESS COATING AND METHOD OF PREPARATION

BACKGROUND OF THE INVENTION

1. Field of the Invention

The present invention relates generally to stencil sheets, and more particularly to such sheets or blanks which are sensitive to the production of a stencil record by mechanical force.

2. Prior Art

Stencil sheets for use in image transfer and reproduction are well known. The stencil sheets used for duplicating generally consist of a special porous tissue paper which is coated with an ink-impervious substance which may be displaced by pressure such as that applied by a typewriter key or stylus. The areas of the stencil sheet where the ink-impervious substance or coating has been displaced permit the passage of the ink, and allow the stencil to be used in a printing process to transcribe the information thus inscribed.

The majority of the stencil sheets presently in use are prepared by applying a solvent solution coating to a thin tissue-like paper with the coating being dried on the paper as the result of solvent vaporization. A wide varity of materials have been proposed and used to constitute the coating, including cellulose nitrate, cellulose ethers and esters, synthetic resins, rubber compounds and even metal films. Both the natural and synthetic resin coatings have conventionally applied by dispersion in a low-boiling solvent system that requires, upon application to the tissue base, the above noted solvent vaporization.

The most popular film forming component in stencil coatings remains cellulose nitrate, as it offers better coating quality at a reduced raw material cost, however the use of low-boiling solvents has remained a primary detractor. In particular, the time required for volatization of the solvents from the applied coating materially increases the total production time necessary to form the finished stencil product. Additionally, the low flash points of the solvents presently in use renders the stencil coating operation hazardous and expensive, as additional equipment is necessary to provide adequate fire prevention and to achieve solvent recovery. Moreover, the discharge of solvents into the atmosphere represents a source of air pollution which is violative of present pertinent Federal Regulations, and is costly to abate.

As noted earlier, other coatings have been investigated which rely upon variant methods of applications, such as the so-called "hot-melt" process, however these coatings have met with limited commercial acceptance and success.

SUMMARY OF THE INVENTION

In accordance with the present invention, a stencil sheet is prepared which comprises a porous, thin tissue base which is coated with a polymerizable coating composition consisting essentially of a film forming component comprising one or more ethylenically unsaturated compounds, a photopolymerization initiator compound compatible with the film forming component, and a modifier component which is nonvolatile and nonreactive with the remaining components of the coating composition.

In a preferred embodiment, the film forming component is comprised of acrylic acid, methacrylic acid and their esters, and certain vinyl compounds such as vinyl ethers and vinyl ketones. The film forming component is present in an amount ranging from about 15 to about 60% by weight, and preferably from 25 to 50% by weight of said coating composition. The photopolymerization initiator is present in amounts of up to 5% by weight and includes compounds such as aromatic ketones, tertiary amines and the like. The exact photopolymerization initiator compound may vary depending upon the presence of a pigment or dye composition in the coating composition, as these latter ingredients may be opaque at the wave lengths at which certain initiator compounds absorb ultraviolet light.

The remainder of the coating composition is constituted by a nonvolatile, nonreactive modifier component which may comprise one or more additives such as plasticizers, pigments, dyes, dispersants, extenders and the like. The coating composition of the present invention is distinctive in that it is prepared and employed exclusive of a dispersing solvent, and, more particularly, materials classifiable as volatile solvents. Accordingly, the method of preparing the stencil sheet of the present invention comprises the preparation of a homogenized, solvent-less liquid mixture of the ingredients constituting the coating composition of the present invention, and the direct application of said homogenized mixture to the tissue base. After completion of the application step, the tissue base bearing the polymerizable or coating composition thereon is exposed to a source of ultraviolet light, where upon the coating composition is polymerized or cured to form the final usable stencil sheet.

The present invention eliminates the need for the application of heat to the coated tissue base, as there is no need for evaporating the solvent. Moreover, the curing or polymerization of the coating composition takes place rapidly at room temperature.

The stencil sheet produced in accordance with the present invention is of high quality and exhibits durability and faithfulness of reproduction in use which is comparable to stencil sheets bearing the conventional cellulose nitrate coating composition thereon. The method for preparing the stencil sheets of the present invention is both economical and safe, as the final preparation of the coated stencil sheet involves a reduced expenditure of energy for the polymerization reaction and avoids the undesirable development of noxious effluent and risk of flammability associated with the use of volatile solvents.

It is a principal object of the present invention to provide a stencil sheet which employs a solventless ink-impervious coating thereon.

It is a further object of the present invention to provide a stencil sheet as aforesaid wherein said ink-impervious coating is cured after application to the stencil tissue base.

It is a yet further object of the present invention to provide a method for preparing a stencil sheet as aforesaid which may be practiced at reduced cost in energy and time, and with a minimum generation of air pollution.

Other objects and advantages will become apparent to those skilled in the art from a consideration of the ensuing specification.

PREFERRED EMBODIMENT

The present invention broadly comprises a stencil sheet composed of a porous tissue base through which the stencil printing ink may pass, and a stencil ink-impervious coating composition adherently disposed on at least one surface thereof. The ink-impervious coating composition of the present invention contains no volatile solvent, and consists essentially of a film forming component prepared from one or more ethylenically unsaturated compounds, a compatible photopolymerization initiator compound and a non-volatile, non-reactive modifier component including one or more materials selected from the group consisting of plasticizers, extenders, pigments, dyes and mixtures thereof. The photopolymerization initiator compounds are provided to absorb ultraviolet wave energy to promote the polymerization of the ethylenically unsaturated compounds to form the cured coating composition, and therefore polymerization of curing of the film forming component may be conducted by exposure to ultraviolet light.

The tissue base forming a part of the stencil sheet of the present invention may be selected from a variety of well-known and widely available materials such as Manilla hemp, or Kozo fiber, in each instance assembled in loose arrangement to provide a foraminous, highly permeable medium through which stencil ink may evenly pass. The choice of a particular tissue base is not critical and may vary according to the transfer characteristics and end application desired or contemplated for a particular type of stencil sheet. The present invention is therefore not limited to a particular tissue base but rather embraces all stencil bases within its scope.

The stencil ink-impervious coating composition is an important aspect of the stencil sheet of the present invention, together with the associated method of preparing the stencil sheet. The present invention differs from stencil manufacture disclosed in the prior art, in that the coating composition as applied to the tissue base is solventless and unpolymerized and is consequently cured after application. This contrasts with the conventional coatings and their related application techniques, in that the conventional coating, if a polymeric material, is already polymerized and is either liquified by heat and thereafter applied to the base, as by the "hot-melt" technique, or is simply dispersed in a volatile solvent which is evaporated from the composition after the coating step is completed. The deficiencies of the solvent dispersion system as described herein have been ennumerated. The "hot-melt" technique has met with limited commercial success, as problems such as excessively high viscosity of the coating, and poor flexibility and shelf life of the resultant stencil have been encountered.

The aforementioned difficulties have been overcome by the coating composition of the present invention which requires neither volatile solvents nor high temperatures for successful application to the tissue base.

The coating composition of the present invention accordingly consists essentially of a film forming component comprising an ethylenically unsaturated polymerizable compound which is present in an amount ranging from about 15 to about 60% by weight. The particular range has been found to be acceptable, as amounts of the film forming component falling below 15% result in coating compositions wherein excessive exudation of the liquid modifiers occurs, while amounts above 60% yield a stencil that is unacceptably hard.

The ethylenically unsaturated compounds useful as the film forming component in the present invention include acrylic compounds such as acrylic acid and methacrylic acid and their esters, vinyl compounds, including vinyl esters such as vinyl acetate, esters of vinyl alcohol, vinyl ethers and N-vinyl-2-pyrolidone. Also included are olefinic compounds such as styrene, methyl styrene, divinyl benzene, esters of unsaturated acids such as crotonic acid, maleic acid and fumaric acid, allyl alcohol esters, and others.

The film forming component preferably employed is an acrylic compound such as acrylic acid and its derivatives. These materials are preferred because of their high reactivity, and rapid polymerization in the present system. One may therefore employ in place of acrylic acid the various esters of acrylic acid, including substituted acrylic acid esters, comprising the alkyl acrylates such as methyl acrylate, ethyl acrylate, butyl acrylate and 2 ethylhexyl acrylate. More complex or polyfunctional esters of acrylic acid may likewise be employed, including the "polyol" substituted esters such as 1,6 hexanediol diacrylate, butanediol diacrylate, neopentyl glycol diacrylate, pentaerythritol tetraacrylate, trimethylolpropane triacrylate, and other similarly substituted esters. Additionally, reaction products between acrylic and methacrylic acid and their respective derivatives, and compounds containing isocyanate or epoxide substituents may be employed as the film forming component. Naturally, a particular acrylic acid derivative may be selected and employed within the skill of the art depending upon the end properties of hardness, and the like, that are desired in the cured coating, and the invention should not be limited to the specific compounds set forth above.

In a preferred embodiment, film forming component comprises a polyfunctional acrylate such as trimethylolpropane triacrylate or 1,6 hexanediol diacrylate, individually or in mixture with each other, and additionally in combination with N-vinyl-2-pyrolidone. The film forming component may be employed in an amount ranging from 15 to 60% by weight, and, more particularly, in amounts ranging from 25–50% by weight.

The foregoing ranges within which the film forming component may be present may be accounted for by the observation that the properties of the stencil product, such as hardness, can be varied at a given concentration of film forming component, Thus, for example, the employment of equal amounts of trimethylolpropane triacrylate and 1,6 hexanediol diacrylate, in place of 100% of the diacrylate results in a harder stencil without altering the total weight percent of film forming component present.

The coating composition useful in the present invention employs a photopolymerization initiator compound to effect the cure of the film forming component after it is applied in monomeric form to the tissue base. As discussed earlier, this application technique results in a reduced expenditure of time and energy in the preparation of the present stencil sheets. A photopolymerization initiator compound is generally provided in an amount of up to about 5% by weight of the coating composition. Suitable photopolymerization initiator compounds are well known in the art and may be selected from those materials which are most compatible with the specific ethylenically unsaturated compounds comprising the film forming component. In particular, the photopolymerization initiator compound may be a keton, including aromatic ketones, such as, for example, benzophenone, substituted benzophenones and acetophenones, and 2 chlorothioxanthone. Also, certain tertiry amines, such as methyl diethanolamine, dimethyl ethanolamine and amyl dimethylamino benzoate may be utilized. These compounds are known to be capable of absorbing radiation in the ultraviolet spectrum and thereby initiating the polymerization or curing reaction that takes place with the film forming component.

In a preferred embodiment, the photopolymerization initiator may comprise a compound selected from the group consisting of 1-phenyl 1,2 porpanedione-2-(orthobenzoyl) oxime, 2,2 dimethoxy-2-phenylacetophenone, 2,2 diethoxyacetophenone, p-tertiary butyl trichlor-acetophenone, benzophenone and chlorinated benzophenone. The particular photopolymerization initiator compound selected depends upon whether a pigment is included in the coating composition, as certain pigments are opaque at the wave lengths that particular initiator compounds may absorb ultraviolet light. Thus, certain other initiator compounds may be selected which would be capable of absorbing ultraviolet radiation at wave lengths where the pigments are more transparent.

The coating composition also includes a modifier component which makes up the remainder of the composition. The modifier component includes various additives such as plasticizers, extenders, where necessary, pigments, dyes, flow control agents and the like. The modifier component is nonreactive and nonvolatile and therefore exerts no adverse effect upon the processing and properties of the coating composition. Generally, the modifier component comprises one or more plasticizers which are included in amounts making up the remainder of the coating composition to impart flexibility and desired frangibility to the cured coating to assure the production of a clear stencil image. The plasticizers which may be used comprise the esters of phthalic acid and other polyfunctional organic acids of similar structure, fatty acid esters such as 2-ethylhexyl stearate, mineral oils, polyisobutylenes, chlorinated hydrocarbons such as chlorinated naphthalenes, phosphoric acid esters such as tricresyl phosphate, aromatic sulfonic acids such as benzene sulfonic acid, and others. These materials may be employed individually or in combination to achieve desired properties in the final coated stencil sheet.

Other modifier components may include dispersants and flow control agents such as aliphatic alcohols containing, for example, 12 to 16 carbon atoms, fatty alcohols such as oleyl alcohol and the like. Certain materials comprising known pigment dispersants may be appropriately included.

As noted earlier, the modifier component may include a pigment or dye, which is usually incorporated for the purpose of identifying the areas of the coating that have been removed during the imprinting process. Pigments and dyes compatible with the film forming component should be chosen which would not interfere with the polymerization or curing reaction. As described earlier, certain pigments and dyes tend to be opaque at the wave lengths at which the photopolymerization initiator compounds absorb ultraviolet light, and such pigments or dyes should accordingly be avoided and others selected which would be compatible with the more efficient and less expensive initiator compounds commercially available. Particular commercially available compatible pigments may comprise for example, titanium dioxide white, 74 Hansa brilliant yellow and 18 reflex blue B. The foregoing materials are exemplary rather than limitative of the invention.

Though the modifier component may be present in an amount constituting the remainder of the present coating composition, it is preferably included in amounts ranging from about 40 to about 85% by weight, and in a preferred embodiment, is present in amounts ranging from 50 to 75% by weight.

The stencil sheet of the present invention may be prepared by a method which comprises preparing the coating composition described above. Specifically, the film forming compound and the corresponding photopolymerization initiator compound may be mixed in any manner well known in the art, together with the modifier component, in the instance where that component is a plasticizer, so as to obtain a homogeneous mixture. Mixing may be carried out in either a continuous or batch-wise fashion at room temperature until the homogeneous mixture is obtained. In the instance where a pigment is to be incorporated in the coating composition, the pigment should be initially milled in a nonreactive modifier ingredient, such as a mineral oil or the like to the desired particle size before it is added to the remaining ingredients for final mixing. For example, the pigment may be reduced to a particle size of 0.5 mil or less, corresponding to a reading of 7 or less on a Hegman gauge.

After the preparation of the homogeneous mixture, the resulting coating composition may then be applied to the tissue base by a variety of well known techinques, such as by floating the tissue base on the top of a quantity of the liquid coating composition, spraying the composition on to the surface of the tissue base, and the like. The particular coating technique is not critical and may vary in accordance with the skill of the art. The coating is preferably applied at a rate of approximately 25 to 35 grams per square meter. Various well known techniques and devices may be employed if desired to maintain the uniformity of coatingg thickness.

After the coating is applied, the uncured coating composition is exposed to ultraviolet radiation to polymerize the film forming component to form the final stencil sheet. As noted earlier, the curing or polymerization of the film forming component occurs rapidly and may be conducted at room temperature. More rapid curing may be achieved by conducting the polymerization in an inert atmosphere, such as nitrogen. The employment of an inert atmosphere is recognized and suitable equipment is commercially available. During the exposure to ultraviolet radiation, ususally from an ultraviolet light source, the coating finally cures and the resulting stencil sheet may be thereafter utilized.

As noted earlier, certain pigments and dyes tend to be opaque at the specific wave lengths at which the photopolymerization initiator compounds absorb ultraviolet light. Thus, one can either select pigments or dyes to be compatible with the photopolymerization initiator compounds, or an alternate source of radiation such as the ionizing radiation of an electron beam may be employed. This latter alternative may be desirable in the instances where the coating composition is necessarily heavily pigmented, or in instances where faster polymerization or curing is desirable.

The following comprise representative examples of coating compositions which may be prepared and applied in accordance with the present invention. The proportions of respective ingredients are specified below in weight percent:

| MATERIAL | WEIGHT PERCENT (%) |
|---|---|
| EXAMPLE I | |
| 1,6 Hexanediol diacrylate | 24.4 |
| dibutyl phthalate | 73.2 |
| benzophenone | 1.2 |
| methyl diethanolamine | 1.2 |
| EXAMPLE II | |
| 1,6 Hexanediol diacrylate | 24.4 |
| ditridecyl phthalate | 73.2 |
| benzophenone | 1.2 |
| methyl diethanolamine | 1.2 |
| EXAMPLE III | |
| 1.6 Hexanediol diacrylate | 19.4 |
| N-vinyl-2 pyrolidone | 13.0 |
| ditridecyl phthalate | 64.4 |
| benzophenone | 1.6 |
| methyl diethanolamine | 1.6 |
| EXAMPLE IV | |
| trimethylolpropane triacrylate | 12.0 |
| 1,6 Hexanediol diacrylate | 12.0 |
| 2 ethylexyl stearate | 73.6 |
| benzophenone | 1.2 |
| methyl diethanolamine | 1.2 |
| EXAMPLE V | |
| 1,6 Hexanediol diacrylate | 19.0 |
| N-vinyl-2 pyrolidone | 19.5 |
| vinyl acetate | 19.0 |
| ditridecyl phthalate | 47.8 |
| 2,2 dimethoxy-2-phenylacetophenone | 4.7 |
| EXAMPLE VI | |
| 1,6 Hexanediol diacrylate | 11.6 |
| N-vinyl-2-pyrolidone | 23.2 |
| ditridecyl phthalate | 54.4 |
| Titanium dioxide | 4.0 |
| 2 chlorothioxanthone | 1.4 |
| amyl ester of dimethyl amino benzoic acid | 1.4 |
| EXAMPLE VII | |
| 1,6 Hexanediol diacrylate | 9.5 |
| 2 ethylhexyl acrylate | 9.5 |
| N-vinyl-2 pyrolidone | 19.0 |
| vinyl acetate | 9.5 |
| 2 ethylhexyl stearate | 47.7 |
| benzophenone | 2.4 |
| methyl diethanolamine | 2.4 |
| EXAMPLE VIII | |
| trimethylolpropane triacrylate | 7.8 |
| N-vinyl-2 pyrolidone | 11.7 |
| ditridecyl phthalate | 78.5 |
| benzophenone | 1.0 |
| methyl diethanolamine | 1.0 |
| EXAMPLE IX | |
| trimethylolpropane triacrylate | 4.7 |
| 2-ethylhexyl acrylate | 9.5 |
| N-vinyl-2 pyrolidone | 19.0 |
| vinyl acetate | 14.3 |
| 2-ethylhexyl stearate | 47.7 |
| benzophenone | 2.4 |
| methyl diethanolamine | 2.4 |

The above examples were found to exhibit useful differences in the primary properties of gloss, feel, hardness and exudation, and thus, the formulations of Example I, V and VIII possesses similar gloss and hardness, while Examples III and IV produced coatings that were dull and soft. Naturally, the foregoing properties may be varied according to the intended utility of the stencil sheet by the selection of particular combinations of materials, and the invention contemplates such variation within its spirit and scope.

The stencil sheets prepared in accordance with the invention exhibit properties in use favorably comparable with the commercially successful products employing the well known cellulose esters. Moreover, the practice of the present invention eliminates the fire hazard, air pollution and processing cost that attends the employment of volatile solvents and the elevated temperatures associated with the "hot-melt" process. A further economy is realized, as the equipment utilized in the curing step requires less physical space than is required by the ovens utilized in the conventional process.

It is to be understood that the invention is not limited to the illustrations described and shown herein, which are deemed to be merely illustrative of the best modes of carrying out the invention, and which are suitable of modifications of form, size arrangement of parts and details of operation. The invention rather is intended to encompass all such modifications which are within the spirit and scope and defined by the claims.

What is claimed is:

1. A stencil sheet suitable for imprinting by mechanical means, said stencil sheet comprising a porous, thin tissue base through which stencil ink may pass, and a stencil ink-impervious coating composition, said coating composition consisting essentially of:

a film forming component present in an amount ranging from about 15 to about 60% by weight, said film forming component comprising an ethylenically unsaturated monomer compound selected from the group consisting of acrylic acid, methacrylic acid, the esters thereof, vinyl esters, vinyl ethers, vinyl ketones, styrene, unsaturated dicarboxylic acids, allyl alcohol esters, and mixtures thereof, a photopolymerization initiator compound sensitive to ultraviolet light, said photopolymerization initiator compound selected from the group consisting of aromatic ketones, tertiary amines, and mixtures thereof, said photopolymerization initiator compound present in an amount of up to about 5% by weight, and a nonvolatile nonreactive modifier component comprising one or more plasticizers.

2. The stencil sheet of claim 1 wherein said plasticizers are compatible with said film forming component and are selected from the group consisting of phthalic acid esters, fatty acid esters, phosphoric acid esters, polyesters, mineral oil and aromatic sulfonic acids.

3. The stencil sheet of claim 1 wherein said photopolymerization initiator compound comprises an aromatic ketone, and said aromatic ketone is selected from the group consisting of benzophenone, 2 chlorothioxanthone, and mixtures thereof.

4. The stencil sheet of claim 1 wherein said film forming component comprises an acrylic acid ester of a polyfunctional compound selected from the group consisting of polyesters and polyols.

5. The stencil sheet of claim 4 wherein said polyols are selected from the group consisting of 1,6 hexanediol, butanediol, neopentyl glycol, pentaerythritol, trimethylolpropane, and mixtures thereof.

6. The stencil sheet of claim 3 wherein said photopolymerization initiator compound comprises methyl diethanolamine.

7. The stencil sheet of claim 1 wherein said film forming component is present in an amount ranging from about 25 to about 50% by weight, said photopolymerization initiator compound comprises about 5% by weight with the remainder comprised by said modifier component.

8. A stencil sheet suitable for imprinting by mechanical means, said stencil sheet comprising a porous, thin tissue base through which stencil ink may pass, and a stencil ink-impervious coating composition, said coating composition consisting essentially of:

a film forming component present in an amount ranging from 25 to 50% by weight, said film forming component comprising an ethylenically unsaturated monomer compound selected from the group consisting of acrylic acid, substituted acrylic acid, the esters thereof, vinyl ketones, and mixtures thereof, a photopolymerization initiator compound sensitive to ultraviolet light, said initiator compound selected from the group consisting of aromatic ketones, tertiary amines, and mixtures thereof, said photopolymerization initiator compound present in an amount of about 5% by weight, and a nonvolatile, nonreactive modifier component comprising one or more plasticizers.

9. The stencil sheet of claim 8 wherein said film forming component comprises an ester of acrylic acid.

10. The stencil sheet of claim 9 wherein said ester of acrylic acid comprises an alkyl acrylate.

11. The stencil sheet of claim 10 wherein said alky acrylate is selected from the group consisting of methyl acrylate, ethyl acrylate, butyl acrylate, 2 ethylhexyl acrylate, and mixtures thereof.

12. The stencil sheet of claim 9 wherein said ester of acrylic acid comprises a compound selected from the group consisting of 1,6 hexanediol diacrylate, butanediol diacrylate, neopentyl glycol diacrylate, pentaerythritol tetraacrylate, trimethylolpropane triacrylate, and mixtures thereof.

13. The stencil sheet of claim 12 wherein said photopolymerization initiator compound comprises a mixture of benzophenone and methyl diethanolamine.

14. The stencil sheet of claim 8 wherein said vinyl ketones include N-vinyl-2-pyrolidone.

15. A coating composition for application to a stencil base, said coating composition consisting essentially of:

a film forming component present in an amount ranging from about 15 to about 60% by weight, said film forming component comprising an ethylenically unsaturated monomer compound selected from the group consisting of acrylic acid, methacrylic acid, the esters thereof, vinyl esters, vinyl ethers, vinyl ketones, styrene, unsaturated dicarboxylic acids, allyl alcohol esters, and mixtures thereof, a photopolymerization initiator compound sensitive to ultraviolet light, said photopolymerization initiator compound selected from the group consisting of aromatic ketones, tertiary amines, and mixtures thereof, said photopolymerization initiator compound present in an amount of up to about 5% by weight, and a nonvolatile, nonreactive modifier component comprising one or more plasticizers.

16. The composition of claim 15 wherein said film forming compound comprises an acrylic acid ester of a polyfunctional compound selected from the group consisting of polyesters and polyols.

17. The composition of claim 15 wherein said polyols are selected from the group consisting of 1,6 hexanediol, butanediol, neopentyl glycol, pentaerythritol, trimethylolpropane , and mixtures thereof.

18. The composition of claim 15 wherein said film forming compound is present in an amount ranging from about 25 to about 50% by weight, said photopolymerization initiator compound comprises about 5% by weight with the remainder comprised by said modifier component.

19. A method for preparing a stencil sheet which comprises:

forming a homogeneous mixture of a coating composition, said coating composition consisting essentially of;

a film forming component present in an amount ranging from about 15 to about 60% by weight, said film forming component comprising an ethylenically unsaturated monomer compound selected from the group consisting of acrylic acid, methacrylic acid, the esters thereof, vinyl esters, vinyl ethers, vinyl ketones, styrene, unsaturated dicarboxylic acids, allyl alcohol esters, and mixtures thereof, a photopolymerization initiator compound sensitive to ultraviolet light, said photopolymerization initiator compound selected from the group consisting of aliphatic ketones, aromatic ketones, tertiary amines, and mixtures thereof, said photopolymerization initiator compound present in an amount of up to about 5% by weight, and a nonvolatile, nonreactive modifier component comprising one or more plasticizers;

providing a porous tissue base and applying said coating compositions to form an ink-impervious coating layer upon at least one surface tissue base; and polymerizing said coating layer by exposure thereof to ultraviolet radiation for a period of time sufficient to completely cure said coating and form a completed stencil sheet.

20. The method of claim 19 wherein said coating composition is applied to said tissue base at a rate of from about 25 to about 35 grams per square meter.

21. The method of claim 19 wherein said mixing, said coating and said polymerizing steps are all performed at room temperature.

22. The method of claim 19 wherein said polymerizing step is performed in an inert atmosphere.

23. The stencil sheet of claim 1 or 8 wherein said modifier component further includes a material selected from the group consisting of extenders, pigments, dyes and mixtures thereof.

24. The composition of claim 15 wherein said modifier component further includes a material selected from the group consisting of extenders, pigments, dyes and mixtures thereof.

25. The method of claim 19 wherein said modifier component further includes a material selected from the group consisting of extenders, pigments, dyes and mixtures thereof.

* * * * *